US007910500B2

(12) United States Patent
Sano et al.

(10) Patent No.: US 7,910,500 B2
(45) Date of Patent: Mar. 22, 2011

(54) FIBER TREATMENT AGENT, FIBER TREATED WITH SUCH FIBER TREATMENT AGENT, FIBER FABRIC, LAMINATE AND METHOD FOR TREATING FIBER

(75) Inventors: Masahiro Sano, Sodegaura (JP); Masashi Sakamoto, Sodegaura (JP); Shigeru Oyama, Sodegaura (JP); Takaharu Yasue, Sodegaura (JP)

(73) Assignee: Idemitsu Technofine Co., Ltd., Tokyo (JP)

( * ) Notice: Subject to any disclaimer, the term of this patent is extended or adjusted under 35 U.S.C. 154(b) by 738 days.

(21) Appl. No.: 11/909,851

(22) PCT Filed: Mar. 27, 2006

(86) PCT No.: PCT/JP2006/306158

§ 371 (c)(1),
(2), (4) Date: Sep. 27, 2007

(87) PCT Pub. No.: WO2006/104095

PCT Pub. Date: Oct. 5, 2006

(65) Prior Publication Data

US 2009/0149095 A1 Jun. 11, 2009

(30) Foreign Application Priority Data

Mar. 28, 2005 (JP) ..... 2005-092086

(51) Int. Cl.
*B32B 3/00* (2006.01)
*D06M 15/423* (2006.01)

(52) U.S. Cl. ..... 442/59; 8/115.51

(58) Field of Classification Search ..... 8/115.51; 428/370, 372, 373, 374; 442/59
See application file for complete search history.

(56) References Cited

U.S. PATENT DOCUMENTS

| | | | |
|---|---|---|---|
| 5,514,737 | A | 5/1996 | Sano et al. |
| 5,718,954 | A | 2/1998 | Sano et al. |
| 2002/0102227 | A1 | 8/2002 | Mikami et al. |

FOREIGN PATENT DOCUMENTS

| | | | |
|---|---|---|---|
| EP | 1 285 945 | | 2/2003 |
| JP | 4-311767 | A | 11/1992 |
| JP | 10-251556 | A | 9/1998 |
| JP | 2970794 | B | 8/1999 |
| JP | 3009499 | B | 2/2000 |
| JP | 2004-84154 | A | 3/2004 |
| WO | WO 98/31868 | A | 7/1998 |

OTHER PUBLICATIONS

Teijin Ltd., Polyurethane Resin Composition Excellent In Hydroscopicity, Abstract of Japanese Publication No. 04-311767 filed Nov. 4, 1992.
Sanyo Chem Ind Ltd., Water-Based Deluster Coating Agent, Abstract of Japanese Publication No. 10-251556 filed Sep. 22, 1998.
Idemitsu Technofine Co. Ltd., Fiber Treating Agent and Fiber Treated With the Fiber Treating Agent, Abstract of Japanese Publication No. 2004-084154 filed Mar. 18, 2004.
European Search Report for EP 06730106 dated Apr. 26, 2010.

*Primary Examiner* — Arti Singh-Pandey
(74) *Attorney, Agent, or Firm* — Millen, White, Zelano & Branigan, P.C.

(57) ABSTRACT

A fiber treatment agent contains components (a) and (b). A fiber treated with the fiber treatment agent and a fiber fabric including the fiber are also provided. The component (a) an insoluble egg-shell membrane fine powder with a mean particle size of 0.1 to 10 μm while the component (b) is a synthetic resin emulsion or a synthetic resin solution.

12 Claims, No Drawings

FIBER TREATMENT AGENT, FIBER TREATED WITH SUCH FIBER TREATMENT AGENT, FIBER FABRIC, LAMINATE AND METHOD FOR TREATING FIBER

TECHNICAL FIELD

The present invention relates to a fiber treatment agent containing an egg-shell membrane fine powder, a fiber that is treated with the fiber treatment agent to have the egg-shell membrane fine powder securely attached on a surface or inside thereof, a fiber fabric and a laminate body each including the fiber, and a fiber treatment method.

BACKGROUND ART

Generally, commercially available fiber products are made of natural fibers such as a cotton, a hemp or a wool, synthetic fibers such as a nylon, a polyester, an acryl or a polyurethane, or compound fibers including the fibers by weaving or the like. Also, an artificial leather or a synthetic leather utilized for a garment, a furniture, an interior of a vehicle (especially for a seat material) is an implementation of the fiber products in a broad sense. Meanwhile, since there has been a variety of features desired for the fiber products depending on the types thereof, for example, as for the fiber products such as a garment or the like contacting to a human skin, features such as moisture absorptivity/desorptivity, water-absorptivity, anti-electrostatic feature and skin effect (hereinafter, the skin effect collectively shows skin curative effect, improvement of moisturiziation, and improvement of skin softness as well as skin elasticity) have been desired.

However, the features owned by the fiber itself have been limited to achieve these features reliably for the fiber products.

Owing to this, various fiber treatment agents containing a hydrophilic material have been provided for providing the features such as the moisture absorptivity/desorptivity, texture, anti-electrostatic feature and the like to the fibers or the fiber products. For example, a polyurethane resin composition is provided (e.g., Patent Document 1), the polyurethane resin composition containing an egg-shell membrane fine particle by 10 to 300 wt % relative to 100 wt % of a polyurethane and showing good moisture absorptivity. Also, a fiber treatment agent is provided (e.g., Patent Document 2), the fiber treatment agent containing a soluble egg-shell membrane, a reactive organic compound having a reactive group and showing good skin effect, moisture absorptivity and wound healing ability. Further, another fiber treatment agent is provided (e.g., Patent Document 3), the fiber treatment agent being made from a natural organic fine powder such as a silk with the mean particle size of 7 μm and an emulsion of a polyacrylic resin, a silicone resin, a polyurethane resin, or the like.

[Patent Document 1] JP-B-3009499
[Patent Document 2] JP-A-2004-84154
[Patent Document 3] JP-B-2970794

DISCLOSURE OF THE INVENTION

Problems to be Solved by the Invention

However, according to the polyurethane resin composition disclosed in the Patent Document 1, since the mean particle size of the egg-shell membrane fine particle is as large as 10 to 20 μm, when the fiber treatment agent is applied to a fiber constituting a garment or the like, the egg-shell membrane fine particle hardly penetrates into the fiber and is easily detached from the fiber etc., and when the agent is applied to a dark fiber or a dark fiber fabric, the egg-shell membrane fine particle might appear whitely on the surface thereof. Further, since the polyurethane resin disclosed in the Patent Document 1 is diluted in a polar solvent which is water-miscible, when it is used as a leather or synthetic leather material, a part of the residual solvent might gradually volatilize, thereby causing undesirable influence on use environment.

Also, since the fiber treatment agent disclosed in the Patent Document 2 using the soluble egg-shell membrane has an egg-specific smell caused by a mercapto group (—SH), it is difficult to use the agent in large amount relative to the fiber. However, if the reactive organic compound is used in large amount to address the smell, the skin effect and texture of the fibers are disadvantageously influenced.

In addition, the fiber treatment agent disclosed in the present patent document employs the soluble egg-shell membrane to improve penetrability of the agent to the fiber, however, the molecular weight of the egg-shell membrane might decrease, which degrades durability in washing, so that the egg-shell membrane fine powder might be detached from the fiber in washing. To solve this, though the fiber treatment agent secures certain washing durability by polymerizing the reactive organic compound with the egg-shell membrane, it is in fact difficult to achieve higher durability (washing durability).

The fiber treatment agent disclosed in the Patent Document 3 does not use the egg-shell membrane fine powder, but the natural organic fine powder such as the silk or the like, however, the feature of the skin effect is inferior to that using the egg-shell membrane fine powder.

Accordingly, an object of the present invention is to provide a fiber treatment agent that can securely and continuously attach an egg-shell membrane fine powder to a fiber sufficiently for providing features like skin effect in addition to moisture absorptivity/desorptivity, water-absorptivity, anti-electrostatic feature and good texture for a fiber and for achieving the features, as well as to provide a fiber treated with the fiber treatment agent and a fiber fabric including the fiber.

Means for Solving the Problems

To address the above-described disadvantages, a fiber treatment agent according to an aspect of the present invention contains components (a) and (b), which are:

(a) an insoluble egg-shell membrane fine powder with a mean particle size of 0.1 to 10 μm; and (b) a synthetic resin emulsion or a synthetic resin solution.

With this arrangement, since the fiber treatment agent contains the egg-shell membrane fine powder, the fiber treatment agent can provide to a fiber certain features of the fine powder, for example skin effect such as skin curative effect, improvement of skin moisturiziation and improvement of skin softness as well as skin elasticity, in addition to moisture absorptivity/desorptivity, water-absorptivity, anti-electrostatic feature and good texture. Also, since the mean particle size is as small as 0.1 to 10 μm, the agent can securely penetrate into the fiber and attach the fine powder to the fiber reliably and securely, but will not generate the egg-shell membrane-specific smell caused by a mercapto group (—SH) because of using the insoluble egg-shell membrane fine powder.

While the mean particle size of the egg-shell membrane fine powder is 0.1 to 10 μm, it is preferable to be 0.1 to 8 μm, and more preferable to be 1 to 6 μm.

Also, since the synthetic resin emulsion or the synthetic resin solution is selected as a binder component for attaching the egg-shell membrane fine powder to the fiber, the fiber treatment agent can securely attach the fine powder to the fiber, and since an arrangement where an organic solvent is not added may be employed, a film preferable for use environment can be formed by applying the fiber treatment agent.

In the fiber treatment agent of the present invention, the component (b) may preferably be a silicone-containing polyacrylic resin and/or a soluble polyurethane resin, or an insoluble polyurethane resin.

With this arrangement, since the particular resin such as the silicone-containing polyacrylic resin and/or the soluble polyurethane resin or the insoluble polyurethane resin (emulsion) is selectively used as the resin for the synthetic resin emulsion or the synthetic resin solution of the component (b), the fiber treatment agent can attach the egg-shell membrane fine powder sufficiently and securely to the fiber, and since an arrangement where an organic solvent is not added may alternatively be employed, a film preferable for use environment can be formed by applying the fiber treatment agent.

In the fiber treatment agent of the present invention, a weight ratio of a solid content of the component (a) to a solid content of the component (b) may preferably be: the component (a)/the component (b)=50/50 to 5/95.

With this arrangement, since the weight ratio of the solid content of the component (a) to that of the component (b) is set within a particular range, the certain features owned by the egg-shell membrane fine powder of the component (a) can be achieved preferably, and the fine powder can properly be attached to the fiber sufficiently and securely.

Preferably, the fiber treatment agent of the present invention may further include a surfactant added by 0.05 to 3.0 wt % relative to 100 wt % of the fiber treatment agent.

With this arrangement, since the surfactant is added by 0.05 to 3.0 wt % relative to 100 wt % of the fiber treatment agent in addition to the components (a) and (b), the egg-shell membrane fine powder can easily penetrate into the fiber, causing washing durability of the fiber to be enhanced.

Preferably, the fiber treatment agent of the present invention may further include a filler to control gloss.

As such filler, an inorganic filler such as a silica, or an organic filler such as an acryl or a polyurethane may be used.

With this arrangement, the filler contained in the fiber treatment agent can control the gloss of the fiber product to be treated.

A fiber according to another aspect of the present invention is a fiber treated with the above-described fiber treatment agent of the present invention.

With this arrangement, since the fiber is treated with the fiber treatment agent of the present invention, the advantages attained by the fiber treatment agent can preferably be provided.

Specifically, since the fiber of the present invention allows the egg-shell membrane fine powder to be attached securely on the surface or the inside thereof, the fiber obtains the good skin effect in addition to the moisture absorptivity/desorptivity, water-absorptivity, anti-electrostatic feature and good texture. Also, since the egg-shell membrane fine powder to be attached is insoluble, the egg-shell membrane-specific smell caused by the mercapto group (—SH) will not be generated, thereby not making a user uncomfortable.

A fiber fabric according to still another aspect of the present invention is treated with the above-described fiber treatment agent of the present invention.

With this arrangement, since the fiber fabric is treated with the fiber treatment agent of the present invention, the same effects and advantages can be attained as that of the fiber of the present invention.

Incidentally, the fiber fabric of the present invention may be manufactured by weaving a fiber in which an untreated fiber is treated with the fiber treatment agent of the present invention to form a fiber fabric, or by weaving an untreated fiber to form a fiber fabric and then being treated with the fiber treatment agent of the present invention.

Preferably, the fiber fabric of the present invention may have the egg-shell membrane fine powder with the attaching amount of 100 to 3000 mg/m$^2$.

With this arrangement, since the attaching amount of the egg-shell membrane fine powder is 100 to 3000 mg/m$^2$, the egg-shell membrane fine powder is sufficiently and securely attached, so that the above-described advantages can reliably and continuously be achieved.

A laminate body according to yet another aspect of the present invention includes a film on one side of a fiber fabric, the film being obtained by applying and drying the above-described fiber treatment agent of the present invention.

A laminate body according to a further aspect of the present invention includes a plurality of layers, the laminate body including a film being obtained by applying and drying the above-described fiber treatment agent of the present invention in at least any one of the layers.

Here, the laminate body of the present invention is a fiber fabric obtained by laminating one or a plurality of layers, which is only required to include the film being obtained by applying the fiber treatment agent in at least one layer.

With this arrangement, since the laminate body has the component treated with the fiber treatment agent of the present invention, the same effects and advantages can be attained as that of the fiber of the present invention.

Incidentally, to sufficiently realize the advantages due to the fiber treatment agent of the present invention, at least an outermost layer exposing to a surface of the laminate body may preferably be treated with the fiber treatment agent of the present invention.

A fiber treatment method according to still a further aspect of the present invention includes the step of treating a fiber with a fiber treatment agent, the fiber treatment agent containing components (a) and (b), which are:

(a) an insoluble egg-shell membrane fine powder with a mean particle size of 0.1 to 10 μm; and (b) a synthetic resin emulsion or a synthetic resin solution.

In the fiber treatment method of the present invention, the component (b) may preferably be a silicone-containing polyacrylic resin and/or a soluble polyurethane resin, or an insoluble polyurethane resin.

In the fiber treatment method of the present invention, a weight ratio of a solid content of the component (a) to a solid content of the component (b) is preferably: the component (a)/the component (b)=50/50 to 5/95.

Preferably, the fiber treatment method of the present invention may further include the step of adding a surfactant by 0.05 to 3.0 wt % relative to 100 wt % of the fiber treatment agent.

Preferably, the fiber treatment method of the present invention may further include the step of including a filler to control gloss.

With the fiber treatment method of the present invention, the same effects and advantages as that of the above-described fiber treatment agent of the present invention can be attained.

In the fiber treatment method of the present invention, as a specific method for applying the fiber treatment agent to the fiber may employ a coating method such as gravure coating suitable for treating one side or both sides, or a dipping method suitable for treating both sides for entire dipping. In this method of the present invention, other treatment method may be employed, and a proper treatment method may be selected depending on a fiber to be treated or to accommodate treatment conditions required.

BEST MODE FOR CARRYING OUT THE INVENTION

A fiber treatment agent of the present invention is a fiber treatment agent for treating a surface of a fiber and contains the following components (a) and (b).

The component (a) is an egg-shell membrane fine powder and so formed that an egg-shell membrane, which is a double thin membranes presented at the boundary of a shell and an albumen of an egg of birds such as a fowl, duck, quail, ostrich, or the like, is separated and purified, and then fine-powderized by a known grinding means, for instance by grinding (wet grinding) performed in water system with a method of freeze-grinding, low-temperature grinding or grindstone, or by grinding (dry grinding) for applying impact with a ball mill or a hammer mill. Since the egg-shell membrane fine powder includes a homogeneous protein, which is mainly composed of a keratin, has good moisture absorptivity and is a white to lightly yellow fine powder, when using it as a component of the fiber treatment agent, the egg-shell membrane fine powder can provide certain features owned by the egg-shell membrane fine powder such as skin effect in addition to moisture absorptivity, good texture, moisture absorptivity/desorptivity, water-absorptivity, anti-electrostatic feature and good texture.

The egg-shell membrane fine powder of the present invention uses the one insoluble in a water. Because the egg-shell membrane fine powder is insoluble, the egg-shell membrane-specific smell will not be generated, thus not making a user uncomfortable. A soluble egg-shell membrane fine powder and a dispersion solution in which the soluble fine powder is dispersed may contain a large amount of mercapto groups (—SH) generating mercaptide derivatives, so that the mercapto group-specific smell may be generated. Due to this, when a fiber fabric or the like is merely dipped with the dispersion solution and then dried, the smell still remains, which is serious disadvantage. In contrast, the insoluble egg-shell membrane fine powder and its dispersion solution will not generate the smell caused by the mercapto group.

Here, in order to selectively obtain the insoluble egg-shell membrane from the above-described egg-shell membrane, for instance, the double membrane (egg-shell membrane) presented at the boundary of a shell and an albumen of an egg of birds such as a fowl, duck, quail, ostrich, or the like is separated and purified, and then fine-powderized by freeze-grinding, low-temperature grinding, or by a known method such as dry grinding for applying impact with a ball or a hammer.

The mean particle size of the egg-shell membrane fine powder insoluble in a water is 0.1 to 10 μm, and preferably be 1 to 6 μm. As the mean particle size of the egg-shell membrane fine powder is 0.1 to 10 μm, the egg-shell membrane fine powder securely penetrates into the fiber, and attaches to the fiber reliably and securely. In contrast, as the mean particle size of the egg-shell membrane fine powder is smaller than 0.1 μm, it may be difficult to be manufactured and handled because it is easily aggregated. Meanwhile, as the mean particle size of the egg-shell membrane fine powder is larger than 10 μm, the powder might whitely appear if the fiber fabric to be treated has dark color, and the egg-shell membrane fine powder may not penetrate into the fiber but easily detached from the fiber. Accordingly, the mean particle size of the egg-shell membrane fine powder is preferably 0.1 to 8 μm, and particularly 1 to 6 μm.

The component (b) is a synthetic resin emulsion or a synthetic resin solution that works as a binder component that securely attaches the egg-shell membrane fine powder of the component (a) to the fiber. For instance, a silicone resin, a polyurethane resin, a polyacrylic resin, a silicone-containing polyacrylic resin, a polyamide resin, a fluorocarbon resin, or the like may be used for such synthetic resin, by using single resin or by combining two or more resins.

Particularly, if employing the silicone-containing polyacrylic resin, the soluble polyurethane resin or the insoluble polyurethane resin for the fiber treatment agent, a large amount of the egg-shell membrane fine powder can even more securely be attached to the fiber, preferably causing the durability of the fine powder in washing to be enhanced.

The silicone-containing polyacrylic resin may be a polymer of a siloxane that is a silicone-containing acrylic monomer, or a polymer of an acrylate or a methacrylate containing a modified silicone in an ester residue, or a copolymer of the silicone-containing acrylic monomer and the acrylic monomer. As an example of latter polymer, there may be a polymer of: an acrylate or a methacrylate of a hydrophilic group such as a polyethylene glycol or the like of an acrylic monomer; or an acrylate or a methacrylate of an aliphatic chain alkyl.

The polyurethane resin is a polyurethane resilient resin obtained by reacting an organic diisocyanate with a long-chain diol, and also with a low molecular chain extender if necessary. More specifically, the organic diisocyanate may be an aromatic diisocyanate such as a 4,4'-diphenylmethane diisocyanate, a naphthalene diisocyanate, a tolylene diisocyanate or a xylylene diisocyanate; or an aliphatic or alicyclic diisocyanate such as a butylene diisocyanate, a hexamethylene diisocyanate, a 4,4'-dicyclohexylmethane diisocyanate, a cyclohexane diisocyanate or a 3,3,5-trimethyl-5-isocyanate methyl cyclohexane isocyanate. The long-chain diol may be a polyether diol such as a polytetramethylene glycol, a polypropylene glycol or a polyethylene glycol; an aliphatic polycarbonate diol such as a polyethylene carbonate, a polybuthylene carbonate or a polyhexamethylene carbonate; or a aliphatic polyester diol such as a polyethylene adipate, a polybuthylene adipate or a polyhexamethylene adipate. If necessary, the low molecular chain extender may be an aliphatic diol such as an ethylene glycol, a butylene glycol or a hexamethylene glycol; an alicyclic diol such as a cyclohexane diol; an aromatic diol such as a xylylene glycol; a diamine such as an ethylene diamine, a propylene diamine or a hexamethylene diamine; or a hydrazine derivative such as a hydrazine, a hydrazide or a hydrazide amino acid. These may be reacted without a solvent and then solved in a polar solvent, or may be reacted in a polar solvent. A process for reaction may be an one-shot process by which the above-described three elements are simultaneously reacted or may be another method by which the organic diisocyanate is reacted with the long-chain diol and then the low molecular chain extender is used if necessary for chain extension reaction.

The weight ratio of the solid content of the insoluble egg-shell membrane fine powder of the component (a) to the solid content of the synthetic resin emulsion or the synthetic resin solution of the component (b) is preferably: the component (a)/component (b)=50/50 to 5/95, and more preferably 45/55 to 15/85. By setting the weight ratio within that range, certain features owned by the egg-shell membrane fine powder of the component (a) can preferably be achieved, and the egg-shell membrane fine powder can sufficiently and securely be attached to the fiber.

In contrast, in the case where the components (a) and (b) represent 100 as a whole, the amount of the egg-shell membrane fine powder may be too small if the weight of the component (a) (the insoluble egg-shell membrane fine powder) is less than 5, so that the above-described certain features provided by the egg-shell membrane fine powder may not be attained, whereas the egg-shell membrane fine powder may easily be detached from the fiber if the weight of the component (a) exceeds 50.

Incidentally, it is preferable to add a surfactant to the fiber treatment agent of the present invention in addition to the components (a) and (b). By adding the surfactant to the fiber treatment agent, the egg-shell membrane fine powder may easily penetrate into the fiber, thus enhancing the washing durability of the fiber.

The type of the surfactant is not particularly limited, and may be a known surfactant such as an anion surfactant, a cation surfactant, a nonion surfactant or an ampholytic surfactant. To be more specific, the surfactant may be the anion surfactant such as a p-nonylbenzene sulfonate sodium, a lauryloxy sulfonate sodium or a lauryloxy phosphate disodium; the cation surfactant such as a lauryl trimethyl ammonium chloride or a cetyl pyridinium chloride; the nonion surfactant such as a polyethylene glycol stearate or a pentaerythrite stearate monoester; or the ampholytic surfactant such as a lauryl dimethyl petain, by using single surfactant or by combining two or more surfactants.

The surfactant is preferably added to 100 wt % of the fiber treatment agent by 0.05 to 3.0 wt %, and more preferably by 0.5 to 1.0 wt %. If the addition amount of the surfactant is less than 0.05 wt %, the egg-shell membrane fine powder may be aggregated or separated, so that the fine powder may hardly penetrate into the fiber in processing. On the other hand, if the addition amount exceeds 3.0 wt %, the surfactant may inhibit a binder function of the synthetic resin emulsion or the synthetic resin solution, resulting in that the washing durability of the egg-shell membrane fine powder may be degraded.

A solvent used for the fiber treatment agent is not particularly limited, and may be a known organic solvent such as a water, an alcohol, a dimethyl formamide, an acetone, a glyoxal resin or an epoxide resin, by using single solvent or by combining two or more solvents. Particularly, the solvent is preferably an aqueous solvent because it is less stimulating against the skin and gives less influence on a living organism, and more preferably a water or an aliphatic lower alcohol having the carbon number of 1 to 3.

The aliphatic lower alcohol with the carbon number of 1 to 3 may be a methyl alcohol, an ethyl alcohol or an isopropyl alcohol, by using single alcohol or by combining two or more alcohols.

In addition to the components (a) and (b), as well as the surfactant and the solvent, an additive may be added to the fiber treatment agent of the present invention if necessary, as long as the object and the advantages of the present invention can be attained. Such additive may be a dispersant, a thickener, an ionization agent, a preservative, or the like.

The fiber treatment agent of the present invention may easily be prepared by mixing the essential component of the components (a) and (b), preferably the surfactant, and if necessary the above-described various additives with the solvent, and agitating these, so that the respective components are dispersed in the fluid component. In this case, the components (a) and (b) may simultaneously be dispersed and diluted in the solvent component, or one of these may be dispersed and diluted and then the other one of these may be dispersed and diluted.

It should be noted that the egg-shell membrane fine powder of the component (a) may insufficiently be dispersed if the components (a) and (b) are mixed by agitating in an ordinary manner, causing the aggregation product of the fine powder to be generated and the fine powder to be detached easily from the fiber easily, so that it is preferable to employ a mixing means not causing such problems.

For example, when these components are processed with a ball mill, the fine powder is well dispersed, and also, by applying pressure to the fine powder, the synthetic resin component further penetrates into or securely attached to the fine powder, which enhances the attachment of the fine powder relative to the fiber.

Also, by processing with the ball mill, the egg-shell membrane fine powder is further fine-powderized, which may improve the texture. As described above, since fine grinding-mixing with an effect provided by the ball mill or other equivalent is desired when mixing these component, a medium agitation mill or the like may be employed.

Since the fiber treatment agent of the present invention obtained as described above contains the egg-shell membrane fine powder (component (a)) with the mean particle size of 0.1 to 10 μm, and the synthetic resin emulsion or the synthetic resin solution (component (b)) is selected as the binder component for attaching the egg-shell membrane fine powder to the fiber, the egg-shell membrane fine powder can securely penetrate into the fiber, be attached to the fiber reliably and securely, and provide to the fiber the certain features owned by the egg-shell membrane fine powder, such as the moisture absorptivity/desorptivity, water-absorptivity, anti-electrostatic feature, good texture, skin effect, and the like. Also, since the insoluble egg-shell membrane fine powder is employed, the egg-shell membrane-specific smell will not be generated. While the mean particle size of the egg-shell membrane fine powder is 0.1 to 10 μm, it is preferable to be 0.1 to 8 μm, and more preferable to be 1 to 6 μm.

The fiber to be treated is not particularly limited, and may be a natural fiber such as a cotton, a wool, a silk or a hemp, a synthetic fiber such as a nylon, an acryl, a polyester, a polypropylene, a polyethylene or a polytrimethylene terephthalate, or a blend fiber or a compound fiber formed by a plural kinds selected from these fibers.

Note that not only the fiber itself, but also a fiber fabric woven with the fiber may obviously be included in such fiber for the subject. The style of the fiber fabric is not limited too, and may be a woven fabric, a knit, an unwoven fabric, or the like. Also, such fiber may be treated with treatment or finishing like scouring, dyeing, antibacterial finishing, soil release finishing, flame-proof finishing, antistatic finishing, or the like. Further, the fiber may be processed as a sewn product like a garment or an underwear, or a product like gloves, socks or bedclothes (a sheet, a cover or Huton, etc.), or may be an unprocessed material of such product.

The subject treated with the fiber treatment agent may not be limited to the fiber, and may be a synthetic leather etc., namely, a laminate body in which the synthetic leather is combined with the fiber or the fiber fabric as one layer or a part of the laminate body.

Incidentally, to sufficiently realize the advantages due to the fiber treatment agent of the present invention, at least an outermost layer exposing to a surface of the laminate body may preferably be treated with the fiber treatment agent of the present invention.

This is merely an example, and may not be limited thereto.

The treatment method using the fiber treatment agent may employ any method, for instance, dipping, padding, or the like. The dipping may be a method of steady placement under room temperature, a method of heating and stirring, or the like. The padding may be a method of pad-drying, a method of pad-steaming, or the like. Any method is applicable.

The fiber (hereinafter, the fiber may include the fiber fabric and the laminate body having such fiber or synthetic resin in a part of the laminate) treated as described above may be dried to eliminate fluid properly and cause the egg-shell membrane fine powder to be attached to the fiber etc. Drying temperature is not particularly limited, but preferably be around 80 to 200° C., and more preferably is around 100 to 180° C.

The fiber of the present invention, which is treated with the fiber treatment agent of the present invention with the attaching amount of the egg-shell membrane fine powder being 100 to 3000 mg/m$^2$, has the egg-shell membrane fine powder attached securely on the surface thereof, and has the good skin effect as well as the moisture absorptivity/desorptivity, water-absorptivity, anti-electrostatic feature, and good texture, will not cause the egg-shell membrane-specific smell, thereby not making a user uncomfortable.

Further, since the fiber of the present invention has the egg-shell membrane fine powder with the attaching amount of 100 to 3000 mg/m$^2$, the egg-shell membrane fine powder is sufficiently and securely attached, so that the above-described advantages can reliably and continuously be achieved. If the attaching amount of the egg-shell membrane fine powder is smaller than 100 mg/m$^2$, the attaching amount may be too small to attain the effect derived from the egg-shell membrane fine powder. On the other hand, if the attaching amount exceeds 3000 mg/m$^2$, the attaching amount may be too large, which causes the egg-shell membrane fine powder to be detached from the fiber and also cause the egg-shell membrane fine powder to whitely appear, consequently degrading the color.

According to the fiber of the present invention, the attaching amount of the egg-shell membrane fine powder is preferably 150 to 2000 mg/m$^2$.

Also, the fiber fabric including the fiber treated with the fiber treatment agent of the present invention can attain the same effects and advantages as that of the fiber of the present invention.

It is obvious that the above-described embodiment merely shows an embodiment of the present invention, the present invention is not limited to the above-described embodiment, and includes modifications and improvements in the content of the present invention as long as the object and the advantage of the present invention can be achieved. In addition, specific arrangements and profiles when implementing the present invention can be other structures and profiles as long as the object and the advantage of the present invention can be achieved.

For example, in the embodiment described above, although the predetermined wet grinding or dry grinding is exemplified as a means of fine-powderization the egg-shell membrane fine powder, it is not limited thereto, and other means may be used.

The specific arrangement, the profile, and the like described in the embodiment of the present invention can be any arrangement and the like as long as the object of the present invention can be attained.

EXAMPLES

The present invention will more specifically be described by providing examples and comparisons, while the present invention will not be limited to the content of the examples and the like.

Example 1

(A) Preparation of Insoluble Shell Membrane Fine Powder:

An insoluble egg-shell membrane in a dry form (manufactured by Q.P. Corporation) was grinded and fine-powderized by using a commercially available ball mill device to obtain the insoluble egg-shell membrane fine powder with the mean particle size of 4.2 μm.

(B) Preparation of Fiber Treatment Solution:

With use of the insoluble egg-shell membrane fine powder obtained by (A), the fiber treatment agent was obtained by mixing, agitating, dispersing the respective components by the ball mill according to the following formulation.

(Formulation of Fiber Treatment Agent)

| Components | Contents (wt %) |
|---|---|
| insoluble egg-shell membrane fine powder obtained by (A) | 1.0 |
| acrylic resin emulsion (solid content) *1 | 5.0 |
| surfactant (p-nonylbenzene sulfonate sodium) | 0.05 |
| water | 94.0 |

*1: LIGHT-EPOCH AX-30 (manufactured by KYOEISHA CHEMICAL Co., LTD)

(C) Preparation of Fiber Fabric:

A cotton woven fabric (100% cotton, weight: 130 g/m$^2$) in A4 size was used as a base fabric and the base fabric was dipped in the fiber treatment agent obtained by (B). After treatment, the fabric was squeezed (squeeze rate: 94%) by a mangle (i.e., a device to which the subject fabric is inserted between two rolls of a metal roll and a rubber roll to squeeze fluid) having the pressure between rolls of 4.0 kg/cm$^2$, and then dried at 110° C. for 10 minutes with use of a commercially available dryer. After drying, the fabric was washed once according to a method with reference to JIS L0217 103, and then dried again under the above-described condition to obtain the fiber fabric. The attaching amount of the egg-shell membrane fine powder was 980 mg/m$^2$.

[Comparison 1]

The fiber treatment agent was obtained according to the same method as Example 1 (B) except that the insoluble egg-shell membrane fine powder was not used (the amount of the fine powder was equally compensated by other respective components) unlike the method of Example 1. Then, the fiber fabric was obtained by the same method as Example 1 (C).

Example 2

(B) Preparation of Fiber Treatment Agent:

With use of the insoluble egg-shell membrane fine powder obtained by Example 1 (A), the fiber treatment agent was obtained by mixing, agitating, dispersing the respective components according to the following formulation.

(Formulation of Fiber Treatment Agent)

| Components | Contents (wt %) |
|---|---|
| insoluble egg-shell membrane fine powder obtained by (A) | 10.0 |
| insoluble polyurethane resin solution (solid content) *2 | 15.0 |
| surfactant (p-nonylbenzene sulfonate sodium) | 0.1 |
| water | 75.0 |

*2: TX9-68 (manufactured by KYOEISHA CHEMICAL Co., LTD)

(C) Preparation of Fiber Fabric:

A nylon knit (weight: 110 g/m$^2$) in A4 size was used as a base fabric, and the base fabric was put into a hot water by bath ratio of 1:15 under the agitation, the fiber treatment agent obtained by Example 1 (B) described above was added by 10 wt % relative to 100 wt % of the base fabric weight, and then the base fabric was treated in the hot water at temperature of 50° C. by agitating it for 30 minutes. After the treatment, the fabric was dehydrated by a centrifugal dehydrator, and then the fabric was dried for 5 minutes with drying temperature being set to 130° C. by a commercially available dryer to obtain the fiber fabric. The attaching amount of the egg-shell membrane fine powder was 660 mg/m$^2$.

[Comparison 2]

The fiber treatment agent was obtained according to the same method as Example 2 (B) except that the insoluble egg-shell membrane fine powder was not used (the amount of the fine powder was equally compensated by other respective components) unlike the method of Example 2. Then, the fiber fabric was obtained by the same method as Example 2 (C).

[Comparison 3]

The fiber treatment agent was obtained according to the same method as Example 2 (B) except that a silk fibroin powder (mean particle size: 4.8 μm) was added instead of the insoluble egg-shell membrane fine powder by the same amount unlike the method of Example 2. Then, the fiber fabric was obtained by the same method as Example 2 (C).

[Reference 1]

The fiber fabric obtained by Example 2 (C) was further washed by a commercially available home automatic washing machine (for 15 minutes) and rinsed 2 times (for 5 minutes each), the one-washing with two-rinsing being repeated for 5 cycles, and then the fabric was dried for 10 minutes with the drying temperature being set to 110° C. to obtain the fiber fabric. The attaching amount of the egg-shell membrane fine powder was 560 mg/m$^2$.

Example 3

According to the method described in Example 1, a polyester woven fabric (100% polyester, weight: 480 g/m$^2$) in A4 size was used as a base fabric, and then the base fabric was dipped in the fiber treatment agent obtained by Example 1 (B) and treated. After the treatment, the fabric was squeezed (squeeze rate: 78%) by the same mangle as the one specified in Example 1, and then dried at 80° C. for 30 minutes with use of a commercially available dryer. After drying, the fabric was washed once according to a method with reference to JIS L0217 103, and then dried again under the above-described condition to obtain the fiber fabric. The attaching amount of the egg-shell membrane fine powder was 1780 mg/m$^2$.

Example 4

With use of the insoluble egg-shell membrane fine powder obtained by Example 1 (A), the fiber treatment agent was obtained by mixing, agitating, dispersing the respective components according to the following formulation.

(Formulation of Fiber Treatment Agent)

| Components | Contents (wt %) |
|---|---|
| insoluble egg-shell membrane fine powder obtained by (A) | 4.5 |
| silicone-containing acrylic resin emulsion (solid content) *3 | 5.5 |
| surfactant (lauryl trimethyl ammonium chloride) | 0.05 |
| water | 90.0 |

*3: LIGHT-EPOCH S86 (manufactured by KYOEISHA CHEMICAL Co., LTD)

Preparation of Fiber Fabric:

With use of the same base fabric as the one used in Example 1 (C), the fiber fabric was obtained by the same method as Example 1 (C) except that the fiber treatment agent described above was used instead of the one in Example 1 (C). Note that the squeeze rate of the mangle was 96% and the attaching amount of the egg-shell membrane fine powder was 1140 mg/m$^2$.

[Comparison 4]

The fiber fabric was obtained according to the same method as Example 3 except that the insoluble egg-shell membrane fine powder was not used (the amount of the fine powder was equally compensated by other respective components).

[Comparison 5]

The fiber treatment agent was obtained according to the same method as Example 1 (B) except that a soluble egg-shell membrane fine powder (manufactured by Q.P. Corporation) was added instead of the insoluble egg-shell membrane fine powder by the same amount according to the formulation described in Example 1 (B).

Then, the fiber fabric was obtained by the same method as Example 3 except that the above-described fiber treatment agent was used instead of the one used in Example 3 (i.e., the fiber treatment agent obtained by Example 1 (B)).

[Examination 1]

The fiber fabrics obtained by the above-described Examples 1, 2, 4 and Comparisons 1 to 3 were examined on "(1) skin softness and elasticity (recovery rate)" according to the following method, then compared and evaluated. The result of the evaluation on the skin softness and elasticity is shown in Table 1.

(1) Skin Softness and Resilience (Recovery Rate):

The skin softness and elasticity (recovery rate) was evaluated by measuring skin heights before, during and after suctioning with use of Cutometer (MPA580: manufactured by Integral Corporation).

Note that the difference between the skin heights before and during suctioning is a tension height (A), which indicates the skin softness.

When considering the difference between the skin heights during and after suctioning as B, the ratio of B and A indicates the skin elasticity (recovery rate). When the skin is fully recovered, the ratio may be B/A=1.

In addition, according to the following procedures, the test fabrics were attached to a human antebrachial region, and then the skin softness and elasticity (recovery rate) were evaluated at respective portions.

(i) A commercially available adhesive tape is attached on the skin of the antebrachial region of a subject and peeled from the skin, and then an acetone/ether solution is applied thereto to cause skin roughness.

(ii) As for the antebrachial test portion of the subject, the difference (A) between the skin heights before and during suctioning and the difference (B) between the skin heights during and after suctioning are measured (check of a pretest state on a measurement portion).

(iii) A test fabric (about 1×1 cm) is stationary placed on the test portion of the subject to continually be attached to the skin for about 8 hours.

(iv) The above-described procedure (iii) is repeated everyday for 16 days.

(iv) 16 days later, the measurement is performed again with use of Cutometer, and rate of a posttest result (16 days) and the pretest result (0 day) (i.e., posttest result/pretest result) is calculated. The mean value is calculated for 5 samples (n=5) of each fiber fabric.

(Result)

TABLE 1

| | Skin Softness (%) | Skin Resilience (Recovery Rate) (%) |
|---|---|---|
| Example 1 | 118 | 105 |
| Example 2 | 113 | 107 |
| Example 4 | 122 | 108 |
| Comparison 1 | 105 | 98 |
| Comparison 2 | 99 | 100 |
| Comparison 3 | 105 | 99 |

According to the result in Table 1, any one of the fiber fabrics of Examples 1, 2 and 4 exceeded 100% in the skin softness as well as the skin elasticity, which was excellent in these features.

In contrast, the fiber fabric of Comparison 1 not using the insoluble egg-shell membrane fine powder unlike Example 1, the fiber fabric of Comparison 2 not using the soluble egg-shell membrane fine powder unlike Example 2, and the fiber fabric of Comparison 3 using the silk fibroin powder instead of the soluble egg-shell membrane fine powder unlike Example 2 were degraded in these features compared to Examples.

[Examination 2]

The fiber fabrics obtained by the above-described Examples 2, Comparisons 2, 3 and Reference 1 were measured on "(2) friction-charged electrostatic potential" and "(3) water-absorption rate" according to the following method, then compared and evaluated. The result of the friction-charged electrostatic potential and the water-absorption rate of the obtained fiber fabrics is shown in Table 2.

(2) Friction-Charged Electrostatic Potential:

Measurement was performed in reference to a method of JIS L1094-B.

(3) Water-Absorption Rate:

Measurement was performed in reference to a method (falling-drop method) of JIS L 1096 6-26-1 A.

(Result)

TABLE 2

| | Friction-charged Electrostatic Potential (V) | Water-absorption Rate (sec) |
|---|---|---|
| Example 2 | 800 | 3 |
| Comparison 2 | 2700 | no absorption even 5 minutes or longer elapsed |
| Comparison 3 | 1200 | 5 |
| Reference 1 | 900 | 2 to 3 |

As shown in the result of Table 2, it could be recognized that the fiber fabric of Example 2 had a proper value of the friction-charged electrostatic potential, which indicated good anti-electrostatic feature. Also, the water-absorption rate was high and the water-absorptivity was excellent.

In contrast, the fiber fabric of Comparison 2 not using the insoluble egg-shell membrane fine powder unlike Example 2 showed a large value of the friction-charged electrostatic potential, which indicated poor anti-electrostatic feature as well as poor water-absorptivity.

Incidentally, the fiber fabric of Comparison 3 using the silk fibroin powder instead of the insoluble egg-shell membrane fine powder unlike Example 2 showed a value of the friction-charged electrostatic potential smaller than the value of Comparison 2, which showed good anti-electrostatic feature as well as good water-absorptivity, however, Example 2 showed more excellent anti-electrostatic feature and higher water-absorption rate than Comparison 3.

[Examination 3]

As for the fiber fabrics obtained by Example 3 and Comparisons 4, 5 described above, measurement of "(4) moisture absorptivity" and "(5) smell check of mercapto group (—SH)" were performed, and then compared and evaluated. The result is shown in Table 3.

(4) Moisture Absorptivity:

The fiber fabrics were stationary placed in an atmosphere at 23° C. with 30% relative humidity for 12 hours for humidity conditioning purposes, then the sample was placed in an atmosphere at 30° C. with 80% relative humidity to calculate a rate of: weight increasing amount/sample weight at humidity conditioning*100(%).

(5) Smell Check of Mercapto Group (—SH):

The presence of the smell of the mercapto group (—SH) that generates the mercaptide derivative was evaluated according to a sensory examination by a licensed smell examiner, based on the following evaluation criteria.

(Evaluation Criteria)

| Evaluation | Contents |
|---|---|
| 0 | no smell |
| 1 | slightly detectable smell |
| 2 | slightly distinctive smell |
| 3 | easily detectable smell |
| 4 | strong smell |
| 5 | extremely strong smell |

(Result)

TABLE 3

| | Moisture Absorptivity (%) | Smell of Mercapto Group |
|---|---|---|
| Example 3 | 0.60 | 0 |
| Comparison 4 | 0.13 | 0 |
| Comparison 5 | 0.31 | 4 to 5 |

As shown by the result in Table 3, the fiber fabric of Example 3 showed good moisture absorptivity and no smell of the mercapto group was recognized.

On the other hand, as for the fiber fabric of Comparison 4 not using the insoluble egg-shell membrane fine powder unlike Example 3, the moisture absorptivity was quite poor compared to Example 3.

Also, as for the fiber fabric of Comparison 5 using the same amount of the soluble egg-shell membrane fine powder instead of the insoluble egg-shell membrane fine powder unlike Example 3, the moisture absorptivity was better than Comparison 4, however the smell of the mercapto group was strong.

Example 5

A laminate body with a polyurethane film adhered on one surface of a polyester knit was treated with the agent having the same composition as Example 1 (B) under the same condition as Example 1 except that the washing and the drying after the washing were not performed.

[Comparison 6]

Treatment was performed in the same manner as Example 5 except that the composition of the agent of Example 1 (B) employed the water (1.0 wt %) instead of the insoluble egg-shell membrane fine powder (1.0 wt %) obtained by Example 1 (A).

Example 6

A laminate body with the polyurethane film adhered on one side of a polyester knit was obtained by applying the treatment agent having the same composition as the Embodiment 1 (B) on a surface of the polyurethane film by 10 g/m$^2$ wet using a gravure coater, and then heating the film at 110° C. for 1 minute in a hot-air dryer.

(Manufacturing Method of Laminate Body)

In manufacturing the laminate body obtained by Example 6, the polyurethane emulsion (Evafanol HA-15/manufactured by NICCA CHEMICAL CO., LTD.) was controlled to 5000 mPa·s with use of a thickener, applied on an exfoliate paper by 120 g/m$^2$ in wet, dried at 120° C. for 2 minutes, and adhered to the polyester knit with use of an adhesive.

[Examination 4]

As for the fiber laminate bodies obtained by Examples 5, 6 and Comparison 6, "moisturiziation improvement of skin surface" was checked according to the following method, and then compared and evaluated.

Also, moisture rate of the skin surface was evaluated with use of a moisture checker (manufactured by Scalar corporation in Japan).

According to the following procedures, the moisture rate of the human antebrachial region was measured before and after the fiber laminate body was attached to each human antebrachial region.

(i) A commercially available adhesive tape is attached on an antebrachial region of a subject and peeled from the skin, and then an acetone/ether solution is applied thereto to cause skin roughness.

(ii) A test portion (point) of the subject is determined and a moisture rate (A) at that portion is measured.

(iii) Then, a polyurethane film surface of the fiber laminate body cut to be 1.5×1.5 cm such that the test portion (point) of the subject is located at the center thereof is stationary placed on the skin in a contacting manner for about 24 hours continually.

(iv) The fiber laminate body is peeled from the test portion of the subject and left the skin for 3 minutes and then the moisture rate (B) at that portion is calculated.

(v) A ratio (B/A) of the moisture rate before and after the laminate body is attached is obtained, and the mean value is calculated for 5 samples (n=5) of each fiber laminate body. If B/A=100%, the moisture rate is equivalent even before and after the test, if B/A shows higher than 100%, the moisturiziation is improved, and if it shows lower than 100%, the moisturiziation is degraded.

As for the fiber laminate bodies obtained in Examples 5, 6 and Comparison 6, the mean value of the moisturiziation improvement of skin surface (B/A) is shown in Table 4.

TABLE 4

| | Moisturiziation Improvement (B/A) |
|---|---|
| Example 5 | 129% |
| Comparison | 105% |
| Example 6 | 133% |

According to the result in Table 4, even the fiber laminate body of Comparison 6 not using the insoluble egg-shell membrane fine powder showed the moisturiziation improvement in some measure. Because the skin intentionally damaged might be steamed due to coverage with the polyurethane film, thus causing healing effect in some measure. In contrast, the skin to which the fiber laminate bodies of Examples 5 and 6 were attached was remarkably improved in terms of the moisturiziation, so that the moisturiziation improvement of the skin due to the insoluble egg-shell membrane fine powder component was recognized.

INDUSTRIAL APPLICABILITY

The fiber treatment agent, the fiber treated with the fiber treatment agent, the fiber fabric and the laminate body each including the fiber, and the fiber treatment method, of the present invention, can be used with advantage in the fields where fiber products are applied, especially in the fields where fiber products with features, such as sports, apparel, hygiene products, car interior, furniture, and bedclothes, are desired.

The invention claimed is:

1. A fiber fabric treated with a fiber treatment agent, wherein the fiber treatment agent contains components (a) and (b), the components (a) and (b) being:

(a) a water insoluble egg-shell membrane fine powder with a mean particle size of 0.1 to 10 μm; and (b) a synthetic resin emulsion or a synthetic resin solution, wherein the egg-shell membrane fine powder is present in an attaching amount of 100 to 3000 mg/m$^2$.

2. A fiber treatment method, comprising treating a fiber fabric with a fiber treatment agent, the fiber treatment agent containing components (a) and (b), the components (a) and (b) being:

(a) a water insoluble egg-shell membrane fine powder with a mean particle size of 0.1 to 10 μm, in an amount of 100 to 3000 mg/m$^2$ attaching to the fiber fabric; and (b) a synthetic resin emulsion or a synthetic resin solution.

3. The fiber treatment method according to claim 2, wherein the component (b) is a silicone-containing polyacrylic resin and/or a soluble polyurethane resin.

4. The fiber treatment method according to claim 2, wherein the component (b) is an emulsion containing an insoluble polyurethane.

5. The fiber treatment method according to claim 2, wherein a weight ratio of a solid content of the component (a) to a solid content of the component (b) is: the component (a)/the component (b)=50/50 to 5/95.

6. The fiber treatment method according to claim 2, further comprising the step of adding a surfactant by 0.05 to 3.0 wt % relative to 100 wt % of the fiber treatment agent.

7. The fiber treatment method according to claim 2, further comprising the step of including a filler to control gloss.

8. The fiber fabric according to claim 1, wherein the component (b) is a silicone-containing polyacrylic resin and/or a soluble polyurethane resin.

9. The fiber fabric according to claim 1, wherein the component (b) is an emulsion containing an insoluble polyurethane.

10. The fiber fabric according to claim 1, wherein a weight ratio of a solid content of the component (a) to a solid content of the component (b) is: the component (a) the component (b)=50/50 to 5/95.

11. The fiber fabric according to claim 1, further comprising a surfactant added by 0.05 to 3.0 wt % relative to 100 wt % of the fiber treatment agent.

12. The fiber fabric according to claim 1, further comprising a filler controlling gloss.

* * * * *